US005911635A

United States Patent [19]

Ogden

[11] Patent Number: 5,911,635

[45] Date of Patent: Jun. 15, 1999

[54] GOLF SWING TRAINING DEVICE

[76] Inventor: Everett L. Ogden, P.O. Box 2721, Ponte Vedra Beach, Fla. 32004

[21] Appl. No.: 08/859,326

[22] Filed: May 20, 1997

[51] Int. Cl.[6] ..... A63B 69/36

[52] U.S. Cl. ..... 473/224; 473/259

[58] Field of Search ..... 473/223, 224, 473/259

[56] References Cited

U.S. PATENT DOCUMENTS

| | | | |
|---|---|---|---|
| 5,184,826 | 2/1993 | Hall | 473/224 |
| 5,330,189 | 7/1994 | Reichow | 473/224 |
| 5,638,300 | 6/1997 | Johnson | 473/223 X |

*Primary Examiner*—George J. Marlo

*Attorney, Agent, or Firm*—Thomas C. Saitta

[57] ABSTRACT

A training device for improving the golf swing by providing immediate feedback of incorrect club positioning in the backswing and forward swing. The device senses the attitude of the club during the swing and comprises a small housing or case which attaches temporarily to the shaft of the golf club adjacent the club grip. Contained within the housing are one or more attitude sensing means, such as a mercury switch, connected in circuit to a power source, such as a battery, and an indicator means, such as a vibrator or an audible alarm, such that the indicator means is activated either when the golf club is correctly maintained during the swing within an acceptable swing path area defined by a limited deviation angle on either side of the ideal swing plane, or alternatively only when the golf club is incorrectly positioned out of the acceptable swing path area.

11 Claims, 4 Drawing Sheets

GOLF SWING TRAINING DEVICE

BACKGROUND OF THE INVENTION

The invention relates generally to golf training or practice devices, and more particularly to such devices used to teach the proper golf club swing technique. Even more particularly, the invention relates to such devices which provide a signal to the golfer indicating that the club is properly positioned on the backswing and forward swing within an acceptable swing path area based on the ideal swing plane.

Consistency is a major factor in the game of golf, and establishing a consistent golf swing is crucial to improving a golfer's game. To achieve success the golfer must develop his or her golf swing in order to contact the golf ball squarely with the club head face. Consistency may be achieved by developing the golfer's muscle memory to recognize the correct swing path and by teaching the correct trigger or stop point to end the backswing and begin the forward driving swing. An ideal swing occupies a swing plane centered on a central hub point about which the golfer rotates the club and arms. Excessive deviation from this ideal swing plane results in erratic golf shots.

It is an object of this invention to provide a device which provides an indication to the golfer that the backswing and forward swing is within an acceptable swing path area based on a predetermined deviation angle from the ideal swing plane. It is a further object to provide an audible or vibratory signal produced by indicator means which tells the golfer whether the swing is properly accomplished. It is a further object to provide such a device which monitors the club shaft attitudinal position to provide the indication. It is a further object to provide such a device which is easily attachable and removable from the golf club, such that the golfer can practice with his or her regular clubs.

SUMMARY OF THE INVENTION

The invention is a training device for improving the golf swing by providing immediate feedback of incorrect club positioning in the backswing and forward swing. The device senses the attitude of the club during the swing and comprises a small housing or case which attaches temporarily to the shaft of the golf club adjacent the club grip. Contained within the housing are one or more attitude sensing means, such as a mechanical tilt switch, mercury switch or other similar device, connected in circuit to a power source, such as a battery, and an indicator means, such as a vibrator or an audible alarm, such that the indicator means is activated either when the golf club is correctly maintained during the swing within an acceptable swing path area defined by a deviation angle on either side of the ideal swing plane, or alternatively only when the golf club is incorrectly positioned out of the acceptable swing path area.

The device may be designed to monitor only the upper portion of the acceptable swing path area above a horizontal axis taken through the central hub point of the ideal swing plane, or it may be designed to monitor from the zero degree point of the ideal swing plane at the golf ball, through the backswing from zero to 270 degrees and back to zero degrees in the forward swing.

DETAILED DESCRIPTION OF THE INVENTION

With reference to the drawings, the invention will now be described in detail with regard for the best mode and the preferred embodiment. In general, the invention is a training or practice device to improve technique in the swinging of a golf club, and in particular to teach the user to repeatedly draw back and swing forward the golf club in the preferred swing plane to insure that the golf ball is struck in the most effective manner.

Figure 1:
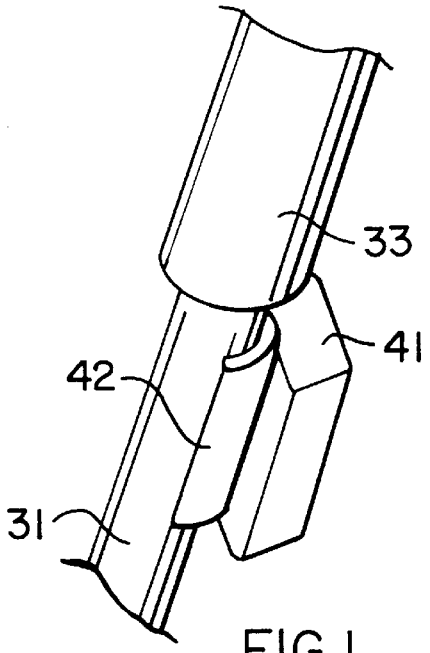
FIG. 1 is a perspective view of the device mounted onto a golf club shaft.

Referring now to FIG. 1, the device is seen to comprise a housing or case member 41 which removably attaches to a golf club having a club shaft 31, club head 32 and club grip 33 by attachment means 42. While the device could be permanently mounted on the club, it is preferred that attachment means 42 allow the device to be removed and transferred to any chosen club for practice, and is shown in the figure as a generally C-shaped clip made of a resilient material which allows the device to be placed onto a narrow portion of the shaft 31 and moved to the wider end of the shaft 31 to abut the grip 33. This allows the user to practice with the actual clubs used in competition. It is preferred that the device be mounted on the shaft 31 adjacent the grip 33, as this location minimizes interference to the golfer's grip and is least disruptive to the club balance, but it is foreseeable that the device may be mounted at different locations. The housing 41 is preferably provided with access to the interior to allow the power means 52, such as a small battery, to be replaced. The housing 41 contains the operation components, consisting of the power means 52, attitude sensing means 53 and indicator means 51, all connected in electrical circuit. The attitude sensing means 53 is a switch which controls current flow from the power means 52 to the indicator means 51, and may comprise a properly mounted mechanical tilt switch, mercury switch or any of other well known devices for sensing attitudinal change in one or more directions. Indicator means 51 comprises any means to provide a signal to the golfer, such as a buzzer, beeper or the like to create an audible signal, or a vibrator device to create a vibratory signal to the golfer which is felt by the hands rather than heard.

Figure 3:
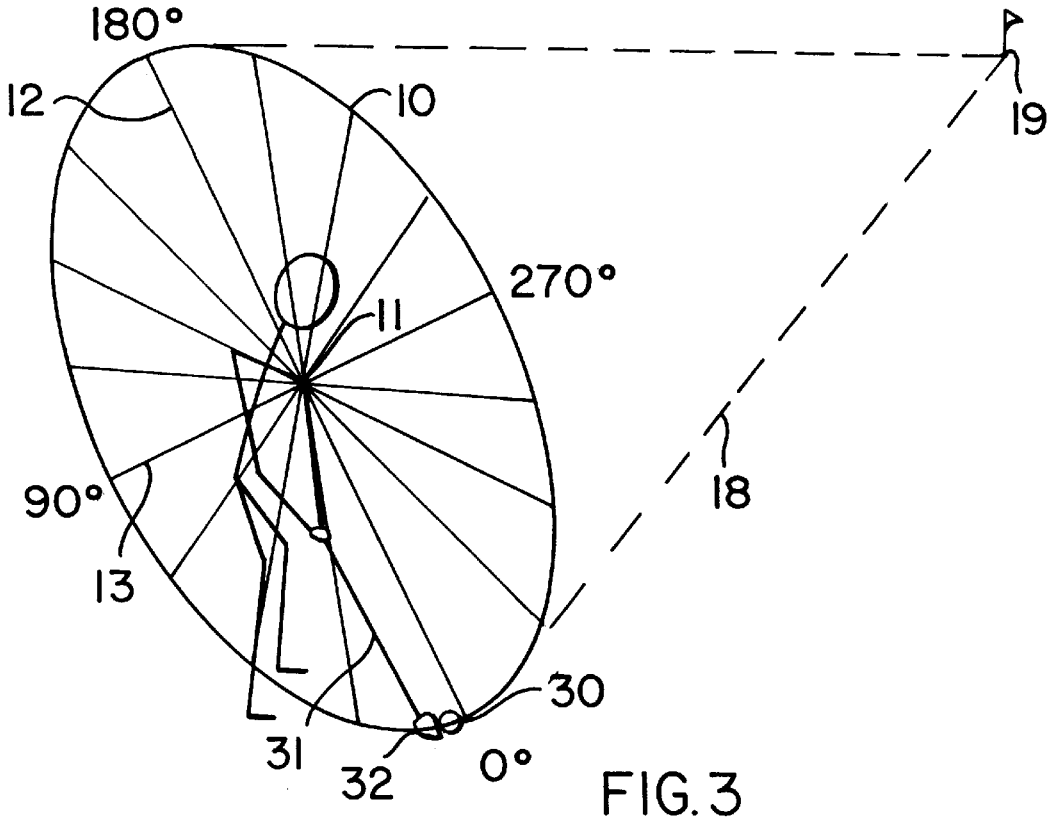
FIG. 3 is a perspective representation of the ideal swing plane.

Referring now to FIGS. 3, 4, 5 and 6, the optimum technique sought to be imparted by the device to the golfer is illustrated. FIG. 3 illustrates the ideal swing plane 10, which is shown as a circle having a central hub point 11 positioned sightly to the front of the golfer's neck or sternum. This central hub 11 is the center point of the golf swing such that the rotation of the club and arms occurs about this point. Ideal golfing technique requires that this central hub 11 remain stationary during the swing. The perimeter of the swing plane circle 10 passes through the point of contact for the golf ball 30. This point of contact is defined to be the zero degree point for reference. A tilted vertical axis 12 extends from the zero degree point through the central hub 11 to the 180 degree point of the swing plane circle 10. A horizontal axis 13 extends from the 90 degree point on the circle 10 through the central hub 11 to the 270 degree point on the circle 10. The horizontal axis 13 is parallel to the target line 18 which extends from the golf ball 30 to the target 19, representing the direction of the intended shot. The ideal backswing and swing consists of drawing the club head 32 and shaft 31 back from the zero degree point along the ideal swing plane circle through the 90 and 180 degree points to the trigger or stopping point, which is short of the 270 degree point, then back down through the 180 and 90 degree points along the ideal swing plane 10 to strike the golf ball 30 at the zero degree point.

Figure 6:
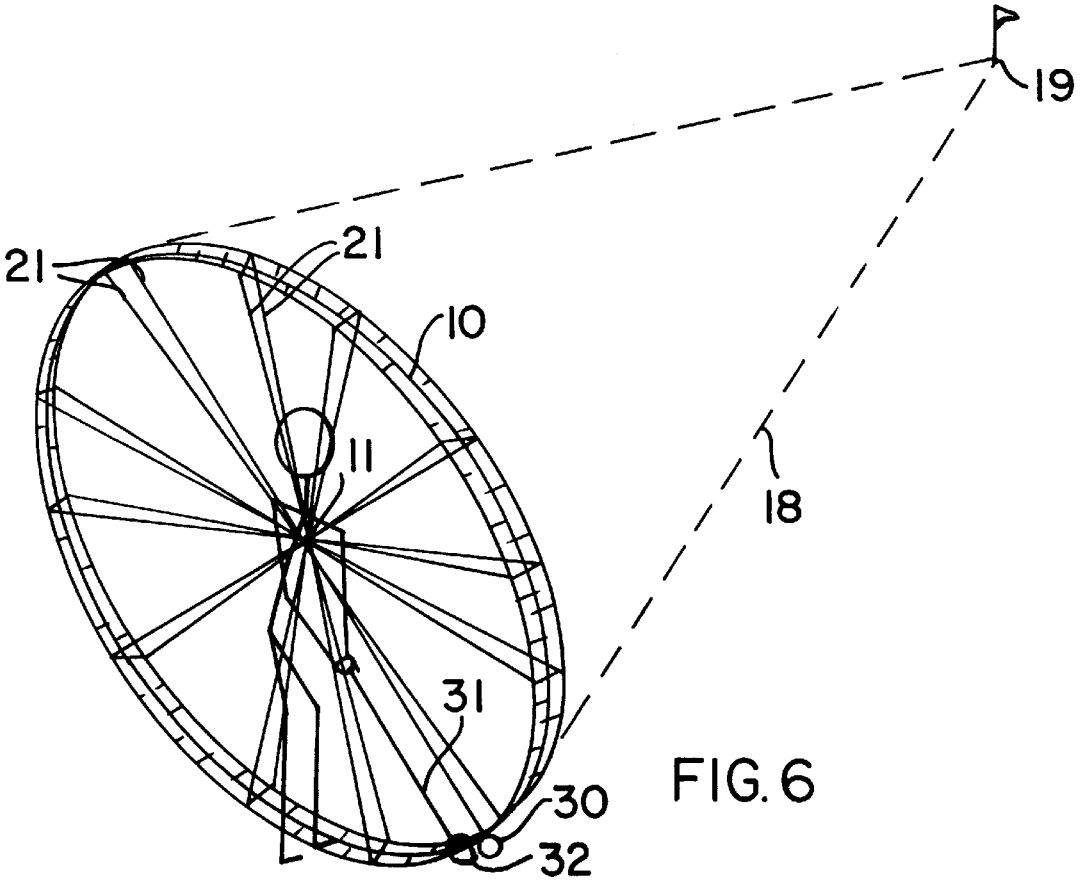
FIG. 6 is a perspective representation of the acceptable swing plane area.
Figure 4:
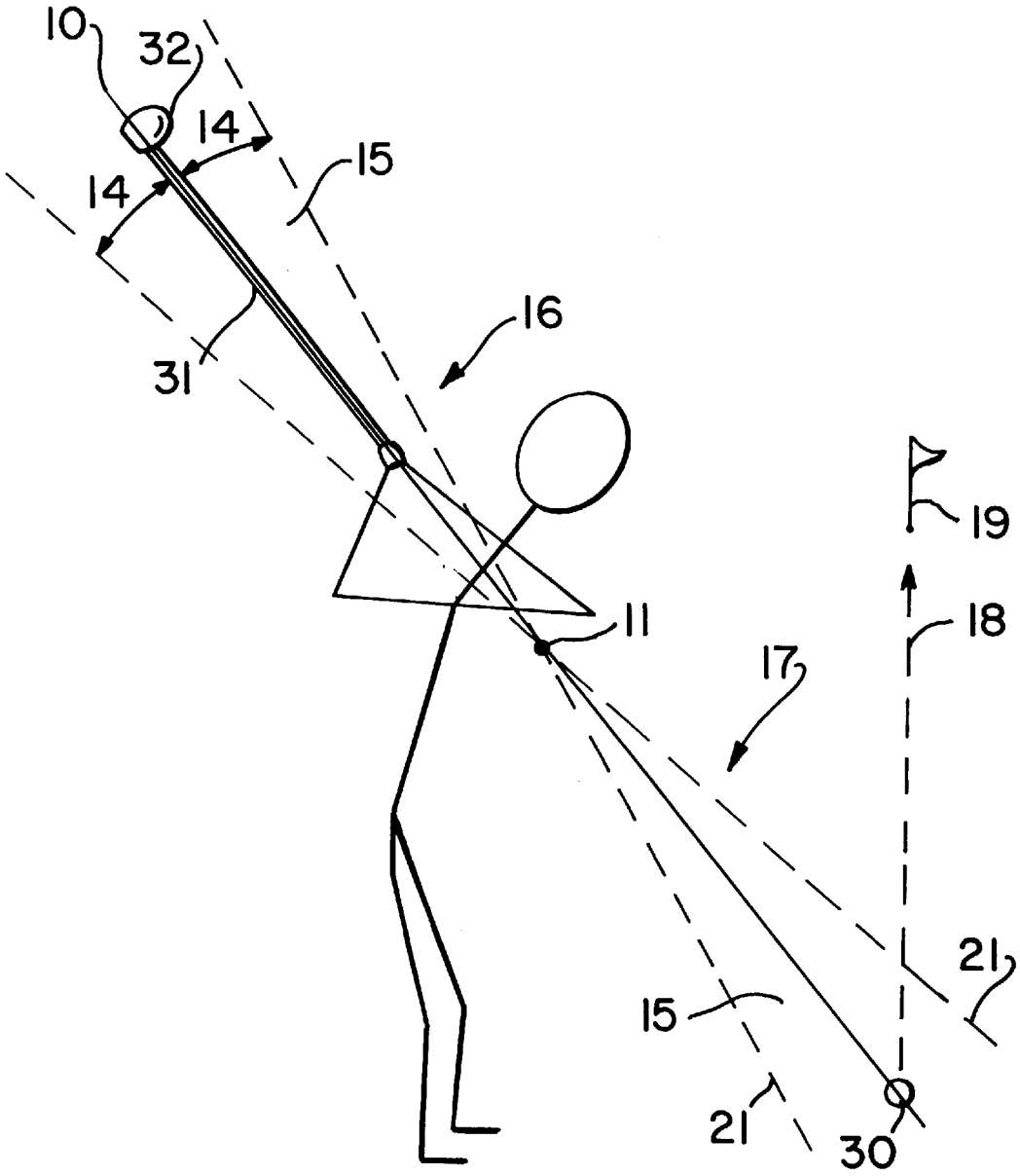
FIG. 4 is a view of a golfer taken facing the perpendicular plane showing the ideal swing plane and the acceptable swing path area defined by the deviation angle.
Figure 5A:
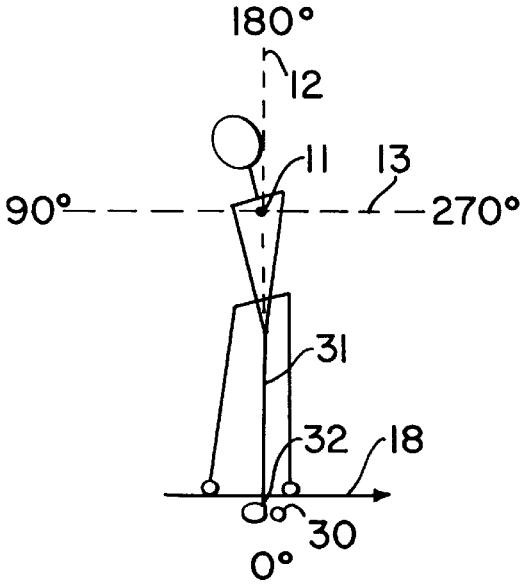
FIGS. 5(*a*) through 5(*d*) are successive representational views of the golf swing taken facing the parallel plane.
Figure 5C:
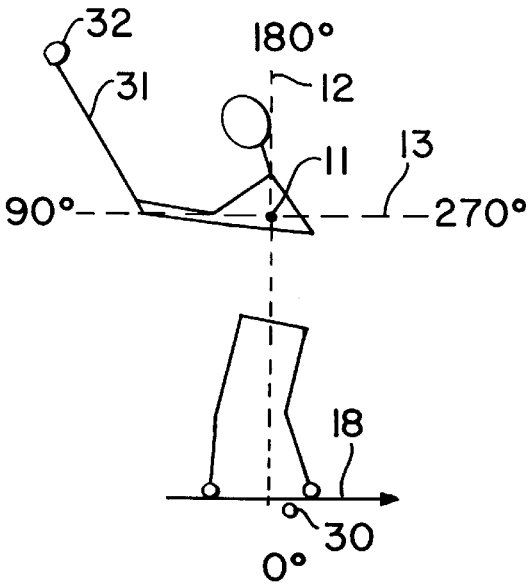
Figure 5B:
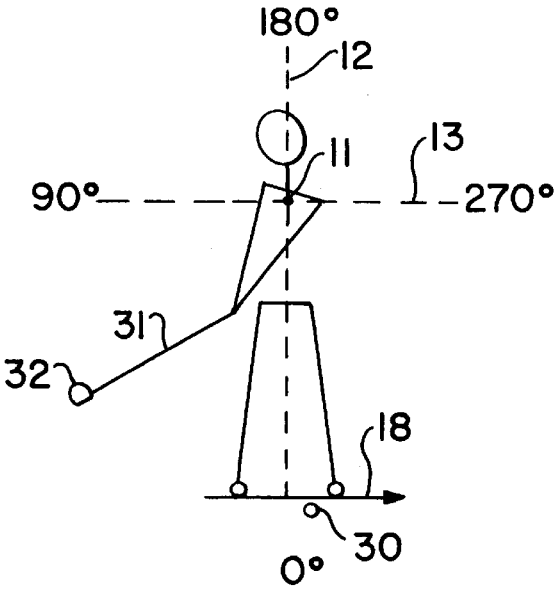
Figure 5D:
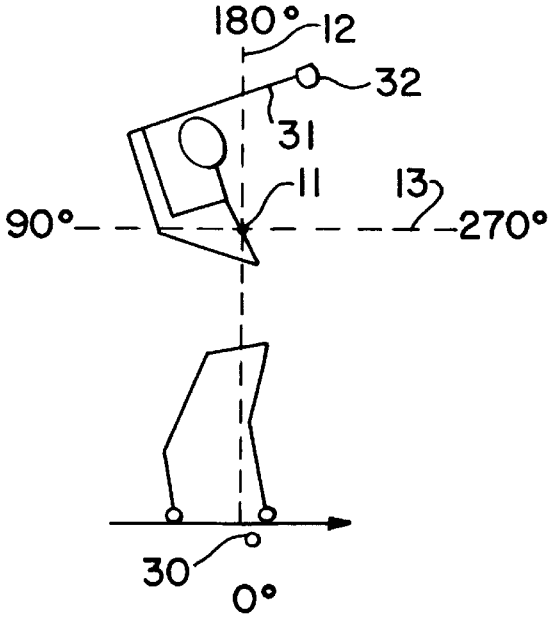

To train the golfer to approximate on a repetitive and consistent basis a golf swing close to the ideal swing, the device provides for an acceptable swing path area 15, as shown in FIGS. 4 and 6. The acceptable swing path area 15 is a symmetrical area extending to either side of the ideal swing plane 10, defined by an infinite number of radial lines 21 which extend through the central hub 11 at a predetermined deviation angle 14 off of the ideal swing plane 10. The acceptable swing path area 15 defined by the radial lines 21 extending in one direction from the central hub 11 thereby consists of a triangular shape when taken in cross-section through the central hub 11 and perpendicular to the ideal swing plane 10. Defined another way, the acceptable swing path area 15 has a cylindrical outer perimeter with two concave conical surfaces meeting at the central hub point 11, the acceptable swing path area 15 being symmetrical about the ideal swing plane 10. The acceptable swing path area 15 can be further divided by the lag horizontal axis 13 into an upper area 16 extending from 90 through 180 to 270 degrees and a lower area 17 extending from 270 through zero to 90 degrees.

The thickness of the acceptable swing path area 15 is determined by the deviation angle 14 chosen. A relatively large deviation angle 14 will provide a large acceptable swing path area 15, while a relatively small deviation angle will provide a small acceptable swing path area 15. The device may be constructed such that the deviation angle 14 is adjustable by adjustment of the attitude sensing means 53, such that a golfers of differing levels will find the device useful for training purposes, and also so that the acceptable swing path area can be decreased as the golfer's skill level increases. For universal purposes, it is preferred that the deviation angle 14 be set at approximately 7.5 degrees from the ideal swing plane 10, such that the acceptable swing path area 15 will encompass a total angular thickness of about 15 degrees in the plane perpendicular to the ideal swing plane 10. Also most preferred is that the acceptable swing path area 15 extend from about 30 to 45 degrees to the rear of true vertical in the upper area 16 as measured on the plane containing the vertical axis 12 perpendicular to the ideal swing plane 10.

As the club is drawn back from the zero degree position, as seen in FIGS. 5(*a*) through 5(*d*), the club passes from an upright attitudinal position at zero degrees where the club head 32 is directly below the club shaft 31, through a horizontal attitudinal position at approximately 90 degrees where the club shaft 31 is horizontal, through an inverted attitudinal position at 180 degrees where the club head 32 is above the club shaft 31, and to the trigger or stopping position at or preferably short of 270 degrees where the club shaft 31 is again generally horizontal. The forward swing is the reverse of this sequence.

Figure 2A:
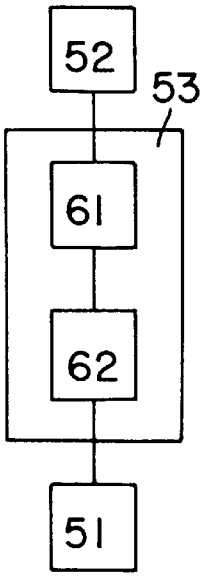
FIGS. 2(*a*) through 2(*c*) are schematic representations of alternative embodiments for the circuitry of the device.
Figure 2B:
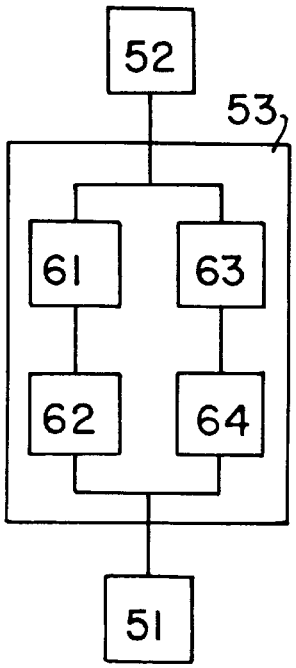
Figure 2C:
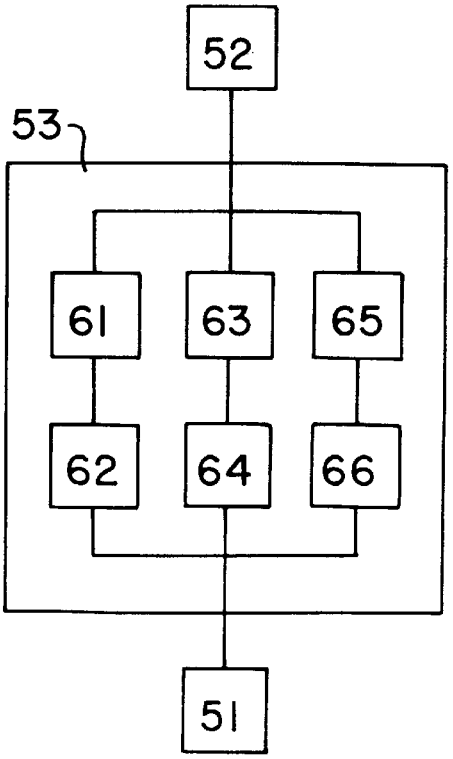

The attitude sensing means 53 monitors the attitudinal position of the club shaft 31 relative to the acceptable swing path area 15. The electrical circuitry between the attitude sensing means 53 and the indicator means 51 can be structured such that the indicator means 51 provides an audible or vibratory signal when the club shaft 31 is properly positioned within the acceptable swing path area 15 or alternatively when the club shaft 31 is not positioned within the acceptable swing path area 15. The most important segment of the acceptable swing path area 15 is the upper area 16 above the horizontal axis 13 which extends from 90 to 270 degrees. Proper club positioning in this area is most crucial during golf swing. To properly monitor the golf club shaft 31 in this segment, it is necessary for the attitude sensing means 53 to sense the attitudinal position relative to the ideal swing plane 10 to determine if the club shaft 31 is within the acceptable swing path area 15, i.e., is within the deviation angle 14, and to simultaneously sense the club shaft 31 attitudinal position relative to the horizontal axis 13, i.e., to sense when the club is in the inverted position. While this sensing may be accomplished by an attitude sensing means 53 comprising a single switch properly aligned and positioned, as for example by use of a mechanical tilt switch of a type well known in the art, it is preferred that the attitude sensing means 53 comprise a pair mercury switches 61 and 62 connected in series, where one mercury switch 61 monitors the angular deviation from the ideal swing plane 10 and the other mercury switch 62 monitors the inverted position, as shown schematically in FIG. 2(*a*). The mercury switches 61 and 62 typically comprise a pair of contacts encased in a sealed glass tube with an amount of conductive mercury. Switch 61 is mounted within the housing 41 such that the switch is closed only when the club shaft 31 is properly positioned within the upper area 16 of the acceptable swing path area 15. Switch 62 is mounted within the housing 41 such that the switch is closed only when the club shaft is in the inverted position between 90 and 270 degrees. With both switches 61 and 62 closed, power is conducted from power means 52 to the indicator means 51 and the signal is produced, indicating to the golfer that the club shaft 31 is properly positioned within the upper area 16 extending from 90 to 270 degrees. If the club shaft 31 is rotated too far during the backswing so that it passes through the horizontal axis 13 at 270 degrees, switch 62 will open and the signal will stop. Likewise, it the club shaft 31 is angled outside the acceptable swing path area 15, switch 61 will open and the signal will stop. Alternatively, the electrical circuitry can be structured in well known manner such that the signal from the indicator means 51 is only produced if the club shaft 31 is improperly positioned out of the acceptable swing path area 15.

It is also possible to structure the device such that attitude sensing means 53 also monitors the club shaft 31 position in the lower area 17 of the acceptable swing path area 15 from zero degrees to 90 degrees. This is accomplished by providing one or two additional sets of mercury switches 63 and 64, and 65 and 66, with switches 63 and 64 in series and switches 65 and 66 in series, each pair of switches in parallel between the power source means 52 and the indicator means 51, as shown schematically in FIGS. 2(*b*) and 2(*c*). Each set of switches monitors a different segment of the acceptable swing path area 15. As before, if the golf club shaft 31 is maintained within the acceptable swing path area 15 during each portion of the backswing and forward swing from 0 degrees through 270 degrees, the indicator means 51 will provide direct audible or vibratory feedback to the golfer.

Although the attitude sensing means 53 has been described in terms of mercury switches, other equivalent devices which are capable of sensing attitudinal positioning may be substituted in any of the embodiments. The mercury switch has the additional advantage of teaching the golfer to bring the club back slowly in the backswing, as too rapid of movement causes the mercury to be moved by centrifugal force, thereby opening the contacts even if the club is properly positioned.

It is contemplated that certain equivalents and substitutions of components may be obvious to those skilled in the art, and therefore the true scope and definition of the invention is to be as set forth in the following claims.

I claim:

1. A golf swing training device comprising:

(A) a golf club having a shaft, a club head and a grip, (B) attitude sensing means to sense the attitudinal position of said golf club relative to an acceptable swing path area, said swing path area being defined relative to an ideal swing plane based on the position of a golf ball to be struck by a golfer, and (C) indicator means to provide an indication signal in response to said attitude sensing means to indicate whether said golf club is positioned within said acceptable swing path area, and (D) means to removably attach said attitude sensing means to said golf club, where said ideal swing plane comprises a circle having a central hub and a perimeter passing through said golf ball at zero degrees, said central hub being the center point of a golf swing, a vertical axis passing through said central hub and said golf ball, said vertical axis passing through said perimeter at zero degrees and 180 degrees, and a horizontal axis passing through said central hub and parallel to a target line between said golf ball and a target, said horizontal axis passing through said perimeter at 90 and 270 degrees;

and where said acceptable swing path area comprises an area defined by radial lines extending through said central hub on either side of said ideal swing plane at a predetermined deviation angle.

2. The device of claim 1; where said acceptable swing path area extends above said horizontal axis from 90 through 270 degrees, and where said attitude sensing means comprise means to sense whether said golf club shaft is within said acceptable swing path area.

3. The device of claim 2, where said deviation angle is approximately 7.5 degrees.

4. The device of claim 2, where said acceptable swing path area further extends below said horizontal axis from zero through 90 degrees.

5. The device of claim 2, where said attitude sensing means comprises means to determine the relative angle of said golf club shaft to said ideal swing plane in a plane perpendicular to said ideal swing plane and passing through said central hub.

6. The device of claim 5, where said attitude sensing means further comprises means to determine the relative position of said golf club shaft on said ideal swing plane circle.

7. The device of claim 6, where said attitude sensing means comprises at least one mercury switch.

8. The device of claim 6, where said indicator means provides said indicator signal when said golf club shaft is not within said acceptable swing path area.

9. The device of claim 6, where said indicator means provides said indicator signal when said golf club shaft is within said acceptable swing path area.

10. The device of claim 6, where said indicator signal is audible.

11. The device of claim 6, where said indicator signal is vibratory.

* * * * *